US008220664B1

(12) United States Patent
Teetzel et al.

(10) Patent No.: US 8,220,664 B1
(45) Date of Patent: Jul. 17, 2012

(54) POWERED HYDRATION SYSTEM

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 988 days.

(21) Appl. No.: 11/704,632

(22) Filed: Feb. 9, 2007

Related U.S. Application Data

(60) Provisional application No. 60/771,930, filed on Feb. 9, 2006.

(51) Int. Cl.
*B67D 7/84* (2010.01)

(52) U.S. Cl. ..... 222/175; 224/148.2

(58) Field of Classification Search ..... 222/94, 222/95, 175, 333, 526–539, 504; 200/302.2; 224/148.1–148.7

See application file for complete search history.

(56) References Cited

U.S. PATENT DOCUMENTS

| | | | | |
|---|---|---|---|---|
| 2,305,482 | A * | 12/1942 | Lester | 200/302.2 |
| 3,197,085 | A * | 7/1965 | Deters et al. | 222/333 |
| 3,246,112 | A * | 4/1966 | Adams et al. | 200/302.2 |
| 4,139,130 | A * | 2/1979 | Glusker et al. | 222/175 |
| 5,571,260 | A * | 11/1996 | Krug | 222/175 |
| 5,645,404 | A * | 7/1997 | Zelenak | 417/1 |
| 6,908,015 | B2 * | 6/2005 | Choi et al. | 222/175 |
| 7,007,502 | B2 * | 3/2006 | Kreutzmann et al. | 62/457.3 |
| 2002/0179647 | A1 * | 12/2002 | Hall et al. | 222/175 |
| 2004/0045980 | A1 * | 3/2004 | Robins | 222/63 |

* cited by examiner

*Primary Examiner* — Lien Ngo
(74) *Attorney, Agent, or Firm* — McLane, Graf, Raulerson & Middleton, Professional Association

(57) ABSTRACT

A personal hydration system resistant to environmental contamination is provided. In a further aspect, a method of delivering fluid to a user is provided.

18 Claims, 8 Drawing Sheets

POWERED HYDRATION SYSTEM

CROSS REFERENCE TO RELATED APPLICATION

This application claims the benefit under 35 U.S.C. §119 (e) of U.S. provisional application Ser. No. 60/771,930, filed Feb. 9, 2006. The aforementioned provisional application is incorporated herein by reference in its entirety.

TECHNICAL FIELD

The present disclosure relates generally to the field of portable hydration systems and, more particularly, to a chemical and biological impervious hydration.

BACKGROUND

Portable hydration systems typically include a flexible reservoir for water or other potable liquid which may be carried in a pack or garment worn by a user. A flexible dispensing tube connected to an outlet of the reservoir and which extends to the mouth of the user allows the user to draw upon the fluid contained within the reservoir. Such systems facilitate fluid replenishment during exercise or other strenuous activities or in unusually warm or dry environments. The conventional portable hydration systems are not generally suitable for use in environments that are contaminated or may potentially be contaminated with noxious or toxic chemical and/or biological agents.

What is needed, therefore, is a portable hydration system that is highly resistant to intrusion by chemical and/or biological hazards. The present disclosure contemplates an improved portable hydration system and method that overcome the above-referenced limitations and others.

SUMMARY

In one aspect, a portable hydration system includes an outer bag formed of a chemical and/or biological resistant material, and a fluid reservoir for containing a volume of a potable fluid removably received within the outer bag and having a fluid outlet. A pump is received within the outer bag and has an inlet and an outlet. The pump inlet is in fluid communication with the reservoir outlet and the pump outlet defines a nozzle through an opening in the outer bag. One or more sealing members are provided for sealing the opening in the outer bag relative to the pump outlet. A dispensing tube formed of a chemical and/or biological resistant material is coupled to the pump outlet and defines a fluid passageway for supplying fluid to a user.

In another aspect, a hydration method comprises providing a hydration system, wherein the hydration system includes an outer bag formed of a chemical and/or biological resistant material; a fluid reservoir for containing a volume of a potable fluid removably received within the outer bag, the fluid reservoir having a fluid outlet; a pump received within the outer bag, the pump having an inlet and an outlet, the pump inlet being in fluid communication with the reservoir outlet, the pump outlet defining a nozzle through an opening in the outer bag; one or more sealing members for sealing the opening in the outer bag relative to the pump outlet; and a dispensing tube formed of a chemical and/or biological resistant material coupled to the pump outlet and defining a fluid passageway for supplying fluid to a user. The fluid reservoir is at least partially filled with a potable fluid and the pump is operated to deliver the potable fluid from the fluid reservoir through the dispensing tube and to the mouth of a user.

One advantage of the present disclosure is that it provides a supply of water or other potable liquid to a user.

Another advantage of the present disclosure is that it provides a chemical and/or biological hardened system while at the same time permitting use of a conventional, non-chemical, non-biological hardened reservoir.

Still another advantage of the present disclosure resides in the user-actuable pump for delivering fluid to the user.

Other benefits and advantages of the present disclosure will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 4 is a cross-sectional view taken along the lines 4—4 in

FIG. 3.

DETAILED DESCRIPTION OF THE PREFERRED EMBODIMENTS

Figure 1:
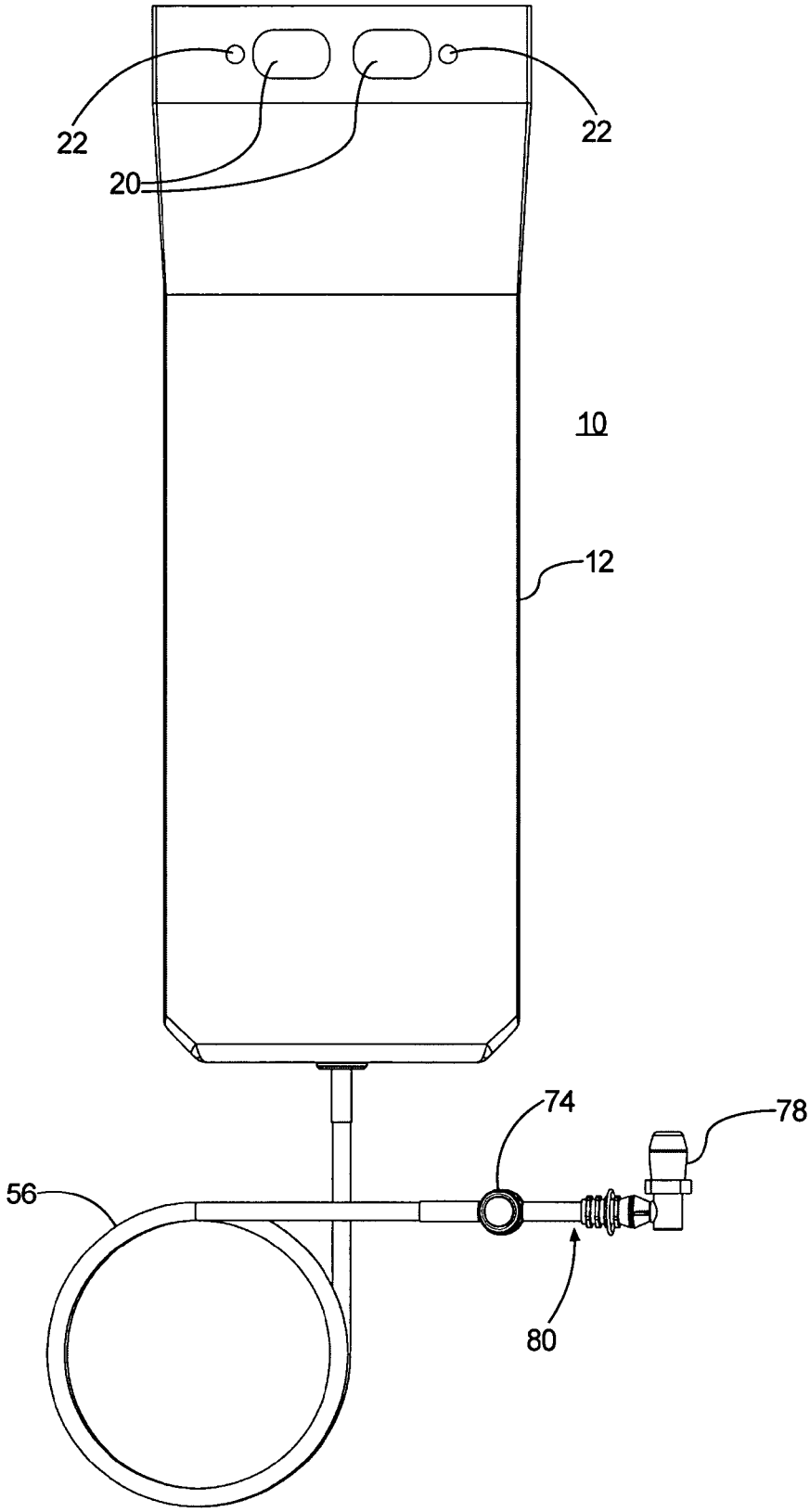
FIG. 1 is a front view of an exemplary portable hydration system embodiment.

Referring to the drawings, a hydration system 10 in accordance with an exemplary embodiment of the present invention includes an outer protective bag 12 containing an inner reservoir or bladder 14 for water or other potable fluid, and a pump 16 for delivering fluid from the reservoir 14 to the mouth of a user.

The outer bag 12 may be formed of any chemical and/or biological resistant material to provide an environmental barrier to chemical agents such as poison or noxious gases, biological agents such as microorganisms and their toxins, and the like. The outer bag may comprises a chemical and/or biological hardened or impervious material. In a preferred embodiment, the outer bag 12 is formed of a high strength fluoropolymer (HSF) sheet material. The bag 12 may include stitched seams which are sealed with HSF tape or other chemical and/or biological impervious tape.

The outer bag 12 is open at the top end, shown generally as 18, and may optionally include openings 20, which may provide a carrying handle. Optional openings 22 may be provided to allow hanging of the unit during storage, handling, or transport. During use, the open end 18 of the bag 12 may closed and sealed against contamination by rolling or folding over. One or more clips or clamps 19 or other like fastener may be provided to secure the rolled or folded end 18 in the closed, sealed position.

As will be appreciated, because of the chemical and/or biological resistance of the outer bag 12, the bladder 14 need not be chemically or biologically hardened. Thus, the bladder may be virtually any type of hydration bladder, including off-the-shelf hydration bladders, such as those available commercially from CamelBak, Hydrastorm, Nalgene, and others. The reservoir 14 is readily replaceable and may be of a reusable type or a single use or disposable type.

The reservoir 14 includes a fluid outlet 24, which is fluidically coupled to an inlet 26 of the pump 16 via tubing 28. Optionally, a releasable fluid coupling system 30 comprising a first member 32 secured to the bladder outlet 24 and a second member 34 attached to an end of the hose 28 may be provided. The fluid connection system 30 may be, for example, a quick connect/disconnect type, and is preferably a dripless or self-sealing type, as are generally known in the art pertaining to connection of fluid-carrying hoses or tubing. Alternatively, the quick connect/disconnect coupling may be omitted and the end of the tube 28 may be friction fit over the outlet nozzle 24, which may be a barbed nozzle or the like. Optionally, a fill port (not shown), e.g., having a removable cover, may be provided on the reservoir 14. Alternatively, the outlet 24 or coupling member 32 may be used as the fill port and a separate fill port may be omitted. In a preferred embodiment, the coupling member 32 includes a self-sealing valve that closes when the coupling members 32 and 34 are disconnected and which opens and permits filling the reservoir when coupled to a faucet or other fluid source.

In the depicted preferred embodiment, the pump 16 includes a housing 36, a power supply 38, a motor 40 electrically coupled to the power supply 38, and an impeller 42 rotatably coupled to the motor 40. The pump housing 36 includes a base 44 which defines a fluidic channel or manifold between the pump inlet 26, the impeller 42 and a pump outlet 46. In operation, the pump draws fluid from the reservoir 14 via the inlet 26 and provides a pressurized fluid stream at the pump outlet 46. Although an impeller pump is shown, it will be recognized that other types of pumps may be utilized.

Figure 4:
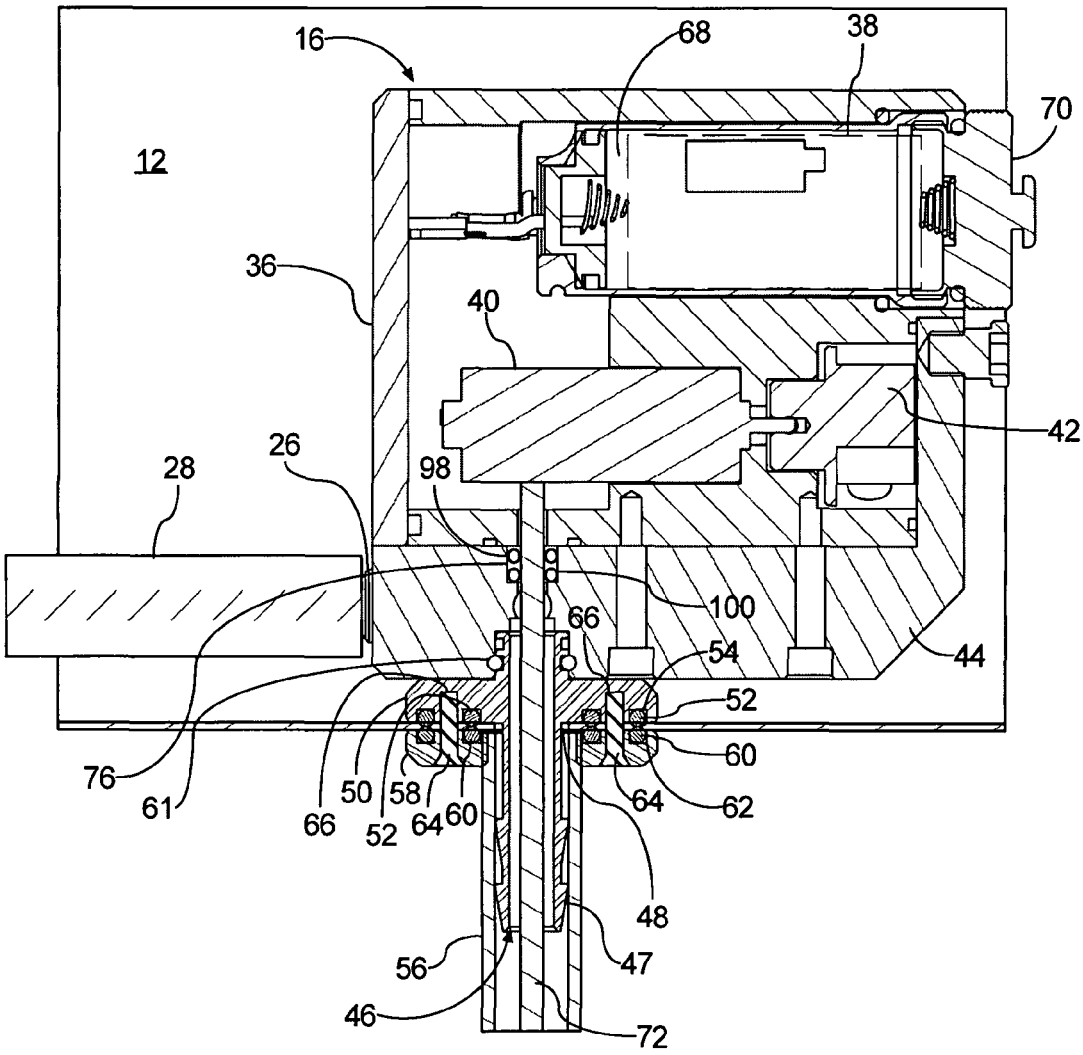
Figure 5:
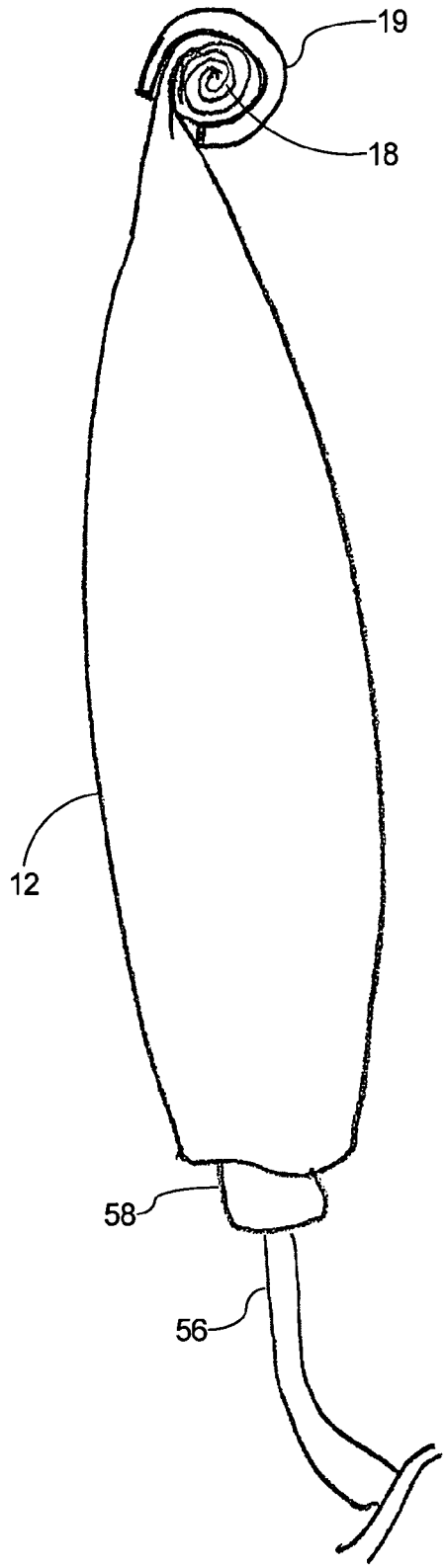
FIG. 5 is a side view of an exemplary hydration system herein, wherein the open end of the outer sleeve is secured with a clip.

The pump outlet 46 may comprise a bulkhead nozzle having a nozzle portion 47, which passes through an opening 48 in the bag 12. A sealing engagement is provided between the pump outlet 46 and the bag 12 to prevent entry of external contamination through the opening 48. As best seen in FIG. 4, the pump outlet 46 includes a flange portion 50 within the bag 12. One or more (two in the depicted embodiment) sealing rings or gaskets 52 are received within complimentary grooves 54 formed in the bulkhead nozzle flange 50 and engage the interior surface of the bag 12, circumscribing the opening 48.

A chemical and/or biological resistant or hardened delivery tube 56 is secured at a first end to the outlet 46. In the depicted embodiment, the outlet 46 defines a barbed nozzle 47 and the tube 56 is friction fit thereover. An annular bulkhead cover 58 is received about the outlet 46 and the hose 56 and engages an exterior surface of the bag 12, circumscribing the opening 48. The bulkhead nozzle 46 and the bulkhead cover 58 may be formed of a chemical and/or biological resistant material, such as nylon, metal or metal alloy such as aluminum, anodized aluminum, or the like. The aperture in the bulkhead cover 58 is sized to provide an environmental seal between the bulkhead cover 58, the tube 56 and the nozzle 48. One or more (two in the depicted embodiment) sealing rings or gaskets 60 are received within complimentary annular grooves 62 formed in the bulkhead cover 58. A plurality of threaded fasteners 64 engage complimentary threaded openings 66 formed in the bulkhead 50 and circumferentially spaced about the opening 48. Preferably, the threaded openings 66 are blind openings to prevent intrusion of contaminants through the fastener openings. The threaded fasteners pass through openings in the bulkhead cover and rotatably engage the threaded openings 66 to provide a clamping action on the O-rings 52, 60 to provide a chemical and/or biological impervious sealing engagement between the bulkhead cover 58, bag 12, and bulkhead 50. A sealing ring or gasket 61 is provided between the bulkhead 50 and housing 36 to provide a liquid-impervious seal therebetween.

The power supply 38 may be one or more disposable or rechargeable batteries or battery packs and is in electrical communication with the motor 40. In the depicted embodiment, the power supply is received within a battery compartment 68, which may be accessed via a removable cover 70 on the housing 46. An insulated electrical conductor 72 is electrically coupled to the power supply 38, the motor 40, and the terminals of a switch 74. The switch 74 is a normally open momentary contact switch, which completes the circuit between the power supply 38 and the motor 40 to operate the pump 16 and deliver a pressurized fluid stream when the switch 74 is actuated by the user. The switch 74 includes a seal such as a gasket or other barrier to provide a chemical and/or biological impervious seal between the tube 56 interior and the external environment. Advantageously, the switch 74 may be located near the distal end 80 of the tube 56, e.g., so as to be located near the user's mouth during use. Of course, the switch 74 may be provided at any desired location along the dispensing tube 56.

The wire 72 extends from within the interior of the housing 36 through an opening 76 therethrough and through the axial bore defined by the nozzle 46 and hose 56. A threaded wire seal 98 and an annular sealing ring or gasket 100 are provided between the wire 72 and the wire through hole 76 to provide a fluid-tight seal between the conductor 72 and the opening 76, thereby preventing fluid traveling in the delivery tube from entering the interior compartment of the housing 36 and possibly short circuiting and/or fouling the motor 40. The conductor 72 is preferably a coaxial wire, e.g., having a generally circular cross-sectional shape, so as to facilitate providing a liquid-impervious seal between the fluid delivery path and the interior compartment of the pump housing 16.

In the depicted embodiment, the dispensing tube includes a so-called bite valve mouthpiece 78 attached to the distal end 80 of the tube 56. The bite valve 78 may be of any standard mouthpiece type having a slit that opens when the user bites down. In operation, to receive liquid, the user simultaneously actuates the switch 74 while biting down on the mouthpiece 78 and a pressurized stream of fluid is delivered to the mouth of the user. Fluid flow is stopped when the switch 74 is released and slit valve 78 is released. Alternatively, the bite valve 78 may be omitted and tube end 80 may be of a suitable type for connection to a standard drink tube fitting on a gas or breathing mask.

Figure 6:
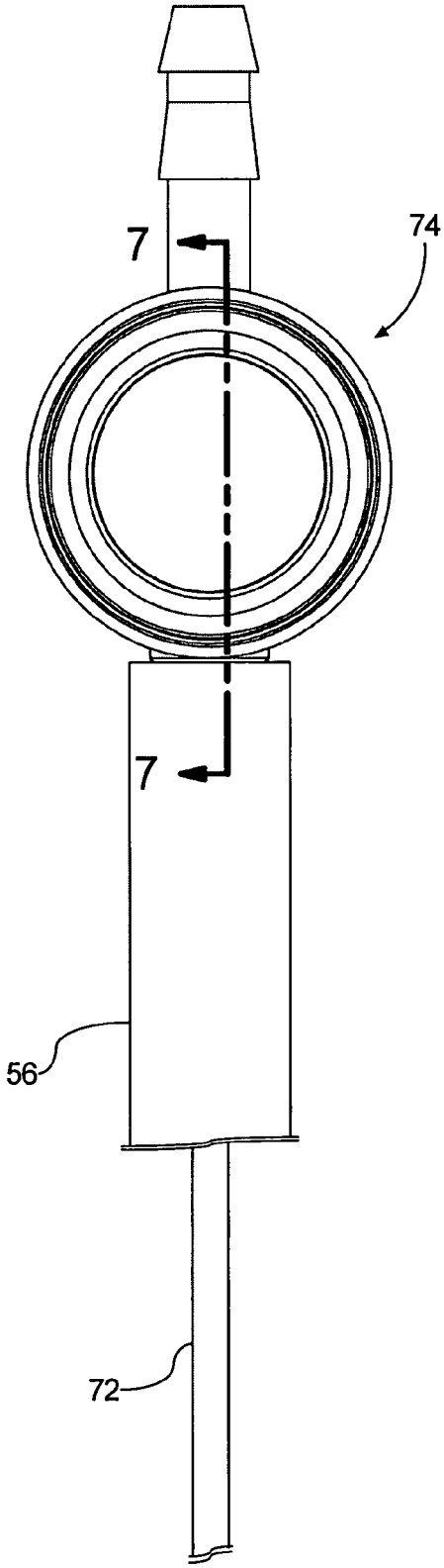
FIG. 6 is an enlarged top plan view of an exemplary embodiment of an environmentally resistant pump activation switch.
Figure 7:
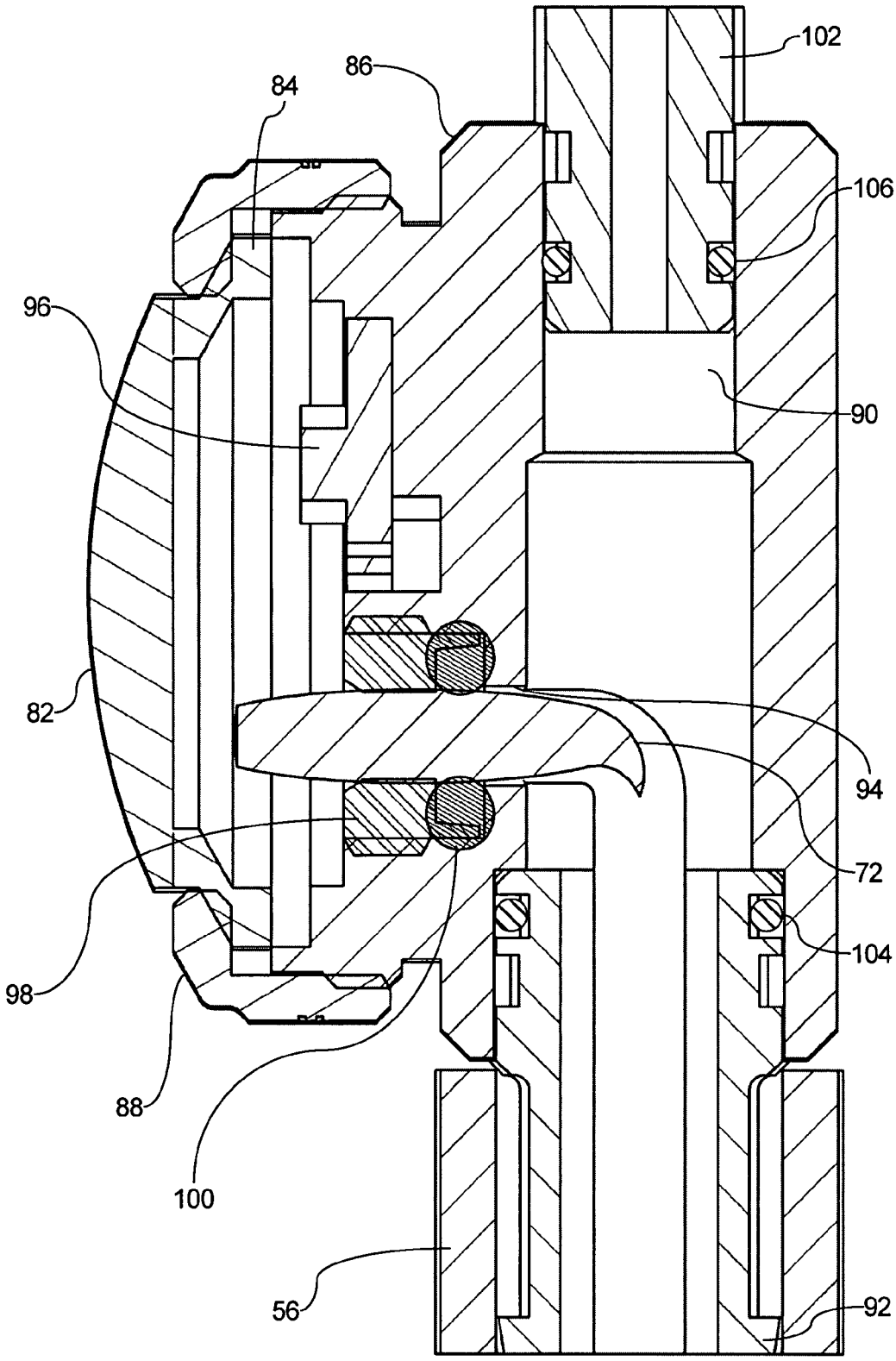
FIG. 7 is a side cross-sectional view taken along the lines 7—7 in FIG. 6.

Referring now to FIGS. 6 and 7, an exemplary sealed switch 74 includes a switch seal 82, which is preferably chemically and/or biologically hardened rubber or other flexible or resilient material. The switch seal 82 includes a peripheral flange 84 which is retained between a switch housing 86 and a switch collar or bezel 88. The switch housing 86 includes a flow passageway 90. An inlet 92, such as a barbed nozzle, is sealingly attached to the switch housing and the hose 56 is sealingly attached to the inlet 92.

An opening 94 extends between the flow passageway 90 and the momentary switch 96, which may be potted in epoxy to provide additional protection against intrusion of external contaminants. The opening 94 provides a passage for the wire 72, which has a pair of conductors that are electrically coupled to the switch 96 contacts or terminals. A threaded wire seal 98 and sealing ring or gasket 100 provide a sealing interference between the opening 94 and wire 72 so as to prevent entry of environmental contamination into the flow passageway 90. An outlet nozzle 102 sealingly engages the switch housing 86 and may be connected with a length of tubing, which in turn may be attached to a bite valve mouthpiece or directly to a drink tube port on a gas mask, or breathing mask, as described above. One or more sealing rings or gaskets 104 may be provided to provide a sealing interference between the inlet nozzle 92 and the switch housing 86. One or more sealing rings or gaskets 106 may be provided to provide a sealing interference between the outlet nozzle 102 and the switch housing 86.

Figure 8:
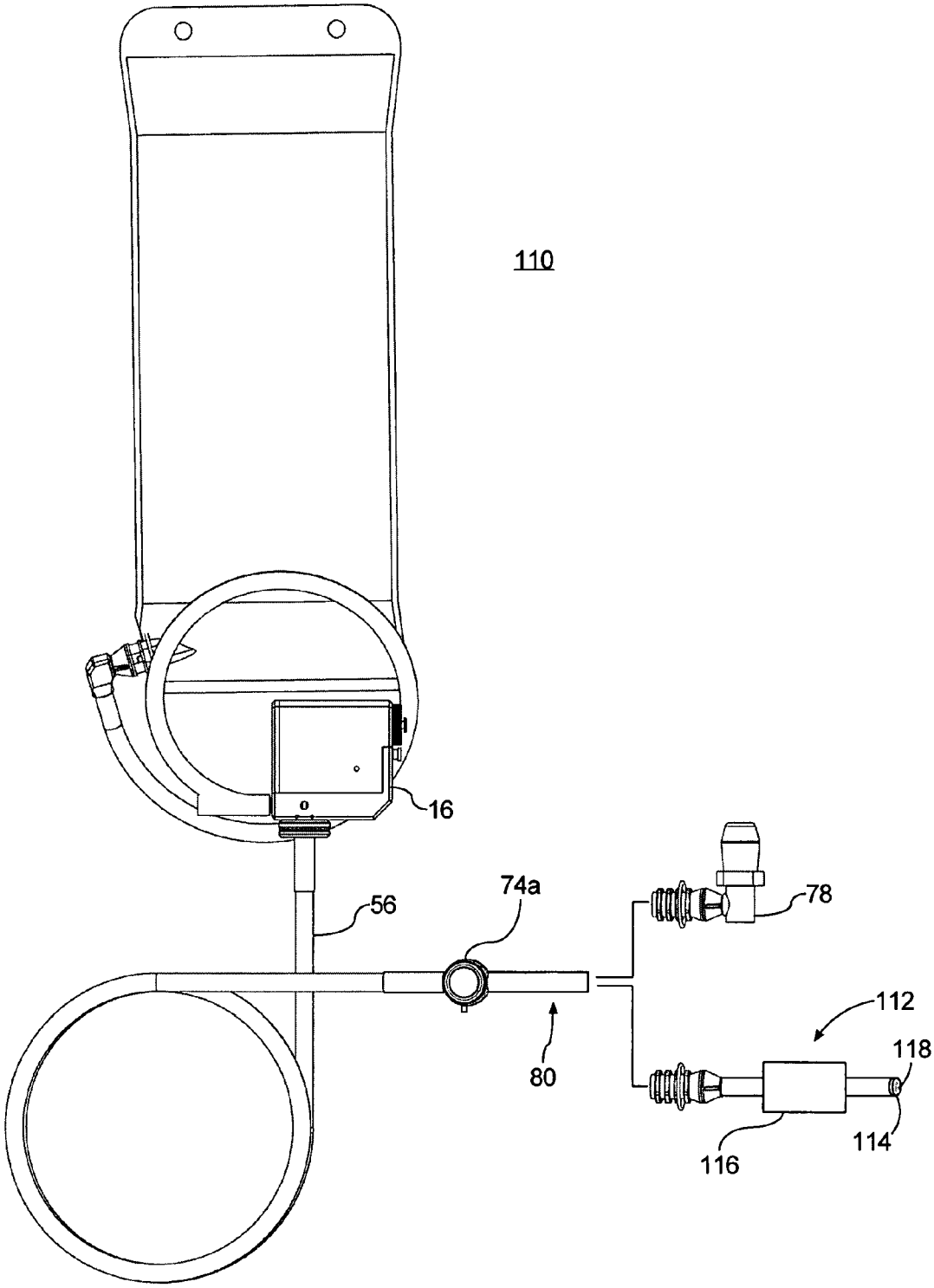
FIG. 8 is a front view of a further embodiment portable hydration system embodiment.

Referring now to FIG. 8, there appears an exemplary hydration system shown generally as 110 which may be as described above, except that the system 110 is further adapted to allow the reservoir to be filled through the dispensing tube 56. It is to be understood that an outer bag 12 as described above is provided, but is omitted in the illustration of FIG. 8 for ease of exposition.

Figure 2:
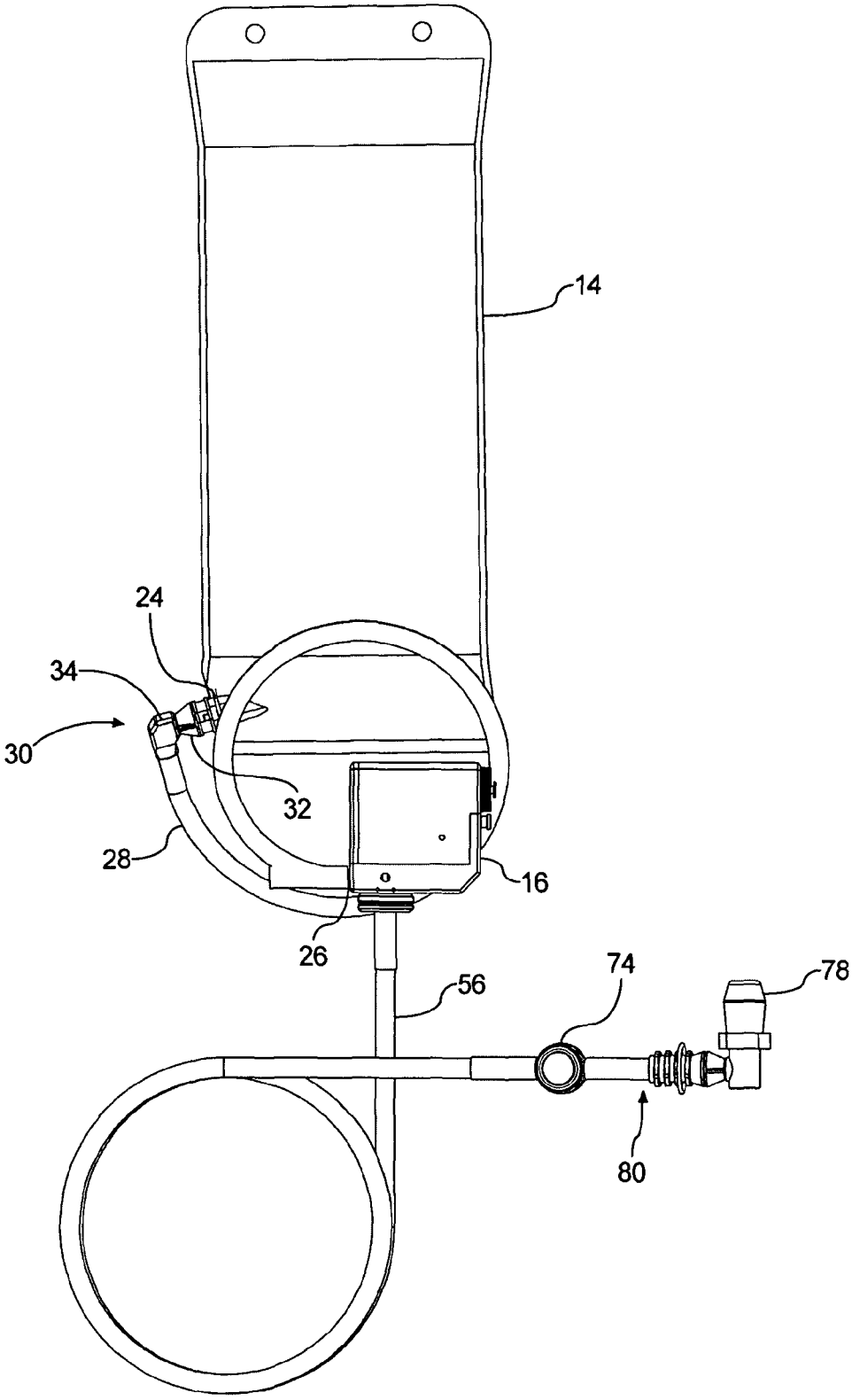
FIG. 2 is a front view of the hydration system of FIG. 1, with the outer bag removed for ease of exposition.
Figure 3:
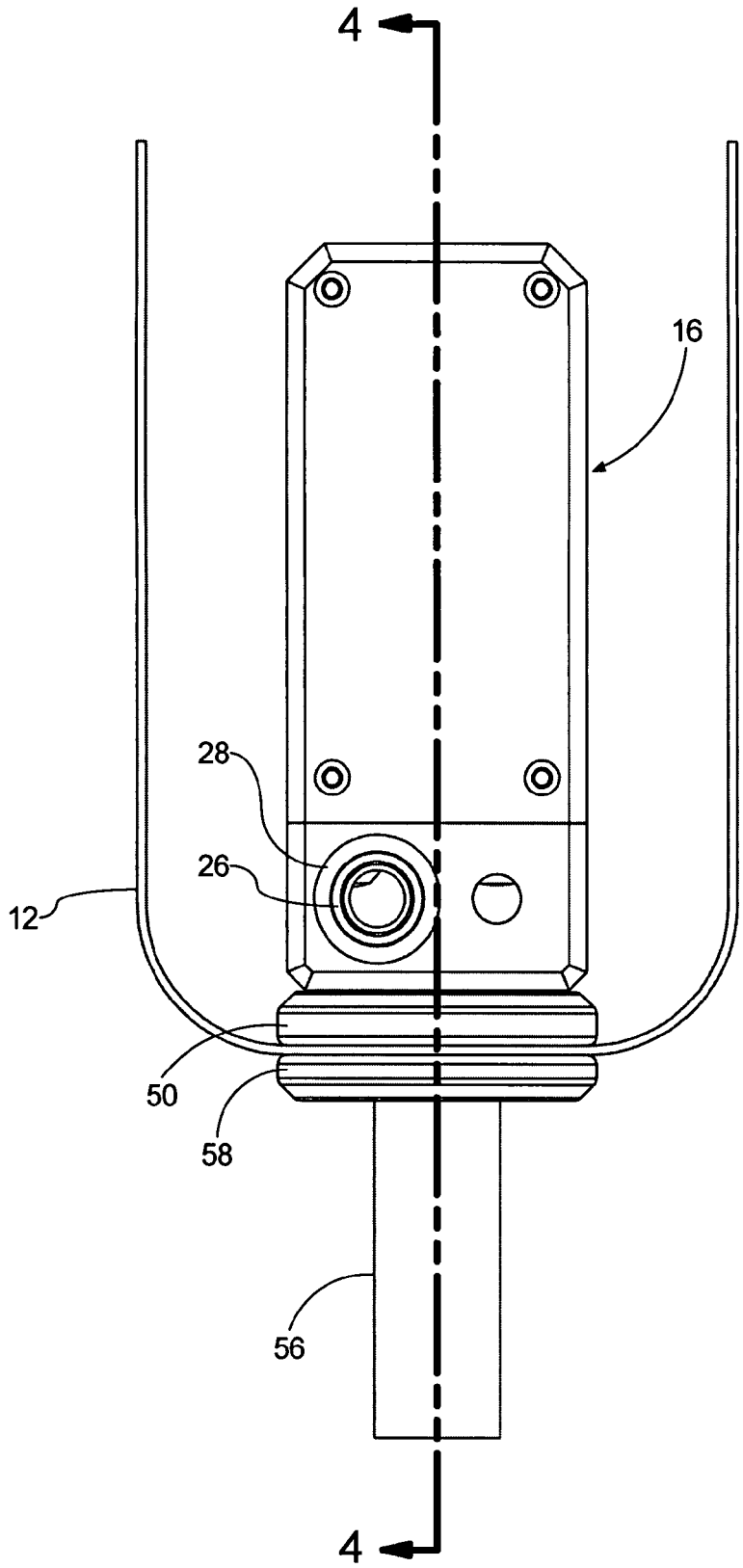
FIG. 3 is a fragmentary side view of the hydration system embodiment of FIG. 1, with the reservoir removed.

The system 110 includes a filtration member 112 which may be removably attached to the tube 56 end 80 in place of the bite valve 78. The switch 74 (see, e.g., FIGS. 1 and 2) may be replaced with one or more switches to allow operation of the pump 16 in a first direction to deliver water from the reservoir 14. In the depicted embodiment, a single switch 74*a*, which may be for example a double pole double throw switch which allows operation of the pump in the forward and reverse directions. Alternately, a first switch (such as the switch 74) may be provided for selectively actuating the pump 16 and a second switch may be provided for selecting the polarity of the pump to select the pumping direction when the pump 16 is actuated.

Of course, the unit 110 may be filled through the tube end 80 directly by reverse operation of the pump 16, e.g., wherein water source is known to be potable. However, where the water source is not potable or the potability is unknown, the filter member 112 may be removably coupled to the distal tube end 80 in place of the valve 78 to prevent entry of contaminants into the tube 56 and the bag 14. The filter member 112 includes an inlet 114 end and an inline filter 116 in the conduit defined by the filter member 112. The filter 116 may be of any type as generally known for the removal of contaminants and/or pathogens from water, including without limitation, HEPA or other mechanical filters, adsorbent filters such as activated carbon or activated alumina filters, diatomite filters, and ion exchange resin filters, and the like. A prefilter 118, which may be, for example, a mesh, screen, or other mechanical filter, may be provided over the inlet end 114. For example, the prefilter 118 may be used to prevent or reduce clogging or fouling of the main filter 116 by filtering the raw water for gross particles before it enters the main filter 116.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A portable hydration system, comprising:

an outer bag;

a fluid reservoir for containing a volume of a potable fluid removably received within said outer bag, said fluid reservoir having a fluid outlet;

a pump received within said outer bag, said pump having an inlet and an outlet, said pump inlet being in fluid communication with said reservoir outlet, said pump outlet including a nozzle extending through an opening in said outer bag;

one or more sealing members for sealing said opening in said outer bag relative to said pump outlet;

a dispensing tube coupled to said pump outlet and defining a fluid passageway for supplying fluid to a user;

a switch mounted on said dispensing tube in electrical communication with said pump, said switch for selectively actuating and deactuating said pump; and a wire passing within said fluid passageway and electrically coupling said pump with said switch.

2. The portable hydration system of claim 1, wherein said outer bag and said dispensing tube are resistant to environmental contamination.

3. The portable hydration system of claim 2, further comprising:

said outer bag is formed of a material which is resistant to one or both of chemical agents and biological agents; and said dispensing tube is formed of a material which is resistant to one or both of chemical agents and biological agents.

4. The portable hydration system of claim 1, wherein said switch is resistant to environmental contamination.

5. The portable hydration system of claim 4, said switch is resistant to one or both of chemical agents and biological agents.

6. The portable hydration system of claim 1, further comprising:

a fastener for releasably sealing an open end of said outer bag.

7. The portable hydration system of claim 1, further comprising:

a length of tubing fluidically coupling said pump inlet and said reservoir outlet.

8. The portable hydration system of claim 7, further comprising:

said length of tubing having a first end having a first fluid connector and a second end attached to said pump inlet; and a reservoir outlet having a second fluid connector, said first and second fluid connectors adapted to be releasably connected to define a flow passageway therethrough.

9. The portable hydration system of claim 1, further comprising:

said outer bag having an open end adapted to be sealed by one or both of folding and rolling said open end over upon itself; and a fastener removably attachable to said outer bag for securing said outer bag in a sealed condition.

10. The portable hydration system of claim 1, further comprising:

a user-actuatable valve located at a distal end of said dispensing tube.

11. The portable hydration system of claim 10, wherein said user-actuatable valve is a bite valve.

12. The portable hydration system of claim 10, further comprising:

said user-actuatable valve is detachable from said dispensing tube; and a filtration member removably attachable to the distal end of said dispensing tube.

13. A hydration method, comprising:

providing a hydration system, said hydration system including:

an outer bag;

a fluid reservoir for containing a volume of a potable fluid removably received within said outer bag, said fluid reservoir having a fluid outlet;

a pump received within said outer bag, said pump having an inlet and an outlet, said pump inlet being in fluid communication with said reservoir outlet, said pump outlet including a nozzle extending through an opening in said outer bag;

one or more sealing members for sealing said opening in said outer bag relative to said pump outlet; and, a dispensing tube coupled to said pump outlet and defining a fluid passageway for supplying fluid to a user; a switch mounted on said dispensing tube in electrical communication with said pump, said switch for selectively actuating and deactuating said pump; and a wire passing within said fluid passageway and electrically coupling said pump with said switch;

at least partially filling said fluid reservoir with a potable fluid; and operating said pump to deliver the potable fluid from said fluid reservoir through said dispensing tube and to a mouth of a user.

14. The method of claim 13, wherein said outer bag and said dispensing tube are resistant to environmental contamination.

15. The method of claim 13, further comprising:

said outer bag is formed of a material which is resistant to one or both of chemical agents and biological agents; and said dispensing tube is formed of a material which is resistant to one or both of chemical agents and biological agents.

16. The method of claim 13, wherein said pump is operated by actuating said switch by the user on said dispensing tube and electrically coupled to said pump.

17. The method of claim 16, wherein said switch is resistant to any one or more of: environmental contamination, chemical agents, and biological agents.

18. A portable hydration system, comprising:

an outer bag;

a fluid reservoir for containing a volume of a potable fluid removably received within said outer bag, said fluid reservoir having a fluid outlet;

a pump received within said outer bag, said pump having an inlet and an outlet, said pump inlet being in fluid communication with said reservoir outlet, said pump outlet including a nozzle extending through an opening in said outer bag;

one or more sealing members for sealing said operating in said outer bag relative to said pump outlet;

a dispensing tube coupled to said pump outlet and defining a fluid passageway for supplying fluid to a user;

said nozzle including a flange adjacent an interior surface of said outer bag and a conduit portion extending from the flange through the opening in the outer bag;

a clamping ring attached to the flange, said clamping ring circumscribing the conduit portion adjacent an exterior facing surface of said outer bag to provide a clamping engagement between the clamping ring, the outer bag, and the flange;

said one or more sealing members disposed between one or both of:

the flange and the interior surface of the outer bag; and the clamping ring and the exterior facing surface of said outer bag.

* * * * *